US010217563B2

(12) United States Patent
Wang et al.

(10) Patent No.: US 10,217,563 B2
(45) Date of Patent: Feb. 26, 2019

(54) METHOD OF MANUFACTURING MULTI-LAYER COIL AND MULTI-LAYER COIL DEVICE

(71) Applicant: CYNTEC CO., LTD., Hsinchu (TW)

(72) Inventors: Chung-Hsiung Wang, Hsinchu (TW); Lang-Yi Chiang, Hsinchu (TW); Wei-Chien Chang, Hsinchu (TW); Yu-Hsin Lin, Hsinchu (TW)

(73) Assignee: CYNTEC CO., LTD., Hsinchu (TW)

( * ) Notice: Subject to any disclaimer, the term of this patent is extended or adjusted under 35 U.S.C. 154(b) by 24 days.

(21) Appl. No.: 14/446,340

(22) Filed: Jul. 30, 2014

(65) Prior Publication Data

US 2015/0035640 A1 Feb. 5, 2015

(30) Foreign Application Priority Data

Aug. 2, 2013 (TW) ..... 102127834 A

(51) Int. Cl.

| | |
|---|---|
| ***C25D 5/02*** | (2006.01) |
| ***H01F 17/00*** | (2006.01) |
| ***H01F 27/28*** | (2006.01) |
| ***H01F 27/29*** | (2006.01) |
| ***H01F 41/04*** | (2006.01) |

(52) U.S. Cl.

CPC ..... *H01F 41/042* (2013.01); *C25D 5/02* (2013.01); *H01F 17/0006* (2013.01); *H01F 27/2804* (2013.01); *H01F 27/292* (2013.01); *H01F 2017/0066* (2013.01); *Y10T 29/4902* (2015.01)

(58) Field of Classification Search

CPC .. C25D 5/02; C25D 5/18; C25D 7/123; H01F 41/04–41/123; H01F 5/003; H01F 2027/2809–2027/2819

See application file for complete search history.

(56) References Cited

U.S. PATENT DOCUMENTS

| | | | | |
|---|---|---|---|---|
| 6,600,404 | B1 * | 7/2003 | Kajino | H01F 5/003 257/531 |
| 7,209,022 | B2 | 4/2007 | Kuroiwa | |
| 2006/0049056 | A1 * | 3/2006 | Wang | C25D 3/02 205/123 |

(Continued)

FOREIGN PATENT DOCUMENTS

| | | | |
|---|---|---|---|
| JP | 63289915 | | 11/1988 |
| JP | 01004091 | A * | 1/1989 |

(Continued)

*Primary Examiner* — Louis J Rufo

(74) *Attorney, Agent, or Firm* — Min-Lee Teng; Litron Patent & Trademark Office

(57) ABSTRACT

A method of manufacturing a multi-layer coil includes steps of providing a substrate; forming a seed layer on the substrate; and plating the seed layer with N coil layers by N current densities according to N threshold ranges, so as to form the multi-layer coil on the substrate, wherein an i-th current density of the N current densities is lower than an (i+1)-th current density of the N current densities. A first coil layer of the N coil layers is plated on the seed layer by a first current density of the N current densities. When an aspect ratio of an i-th coil layer of the N coil layers is within an i-th threshold range of the N threshold ranges, an (i+1)-th coil layer of the N coil layers is plated on the i-th coil layer by the (i+1)-th current density.

19 Claims, 5 Drawing Sheets

(56) References Cited

U.S. PATENT DOCUMENTS

| | | | | |
|---|---|---|---|---|
| 2006/0213778 | A1* | 9/2006 | Cheng | C25D 5/02 205/105 |
| 2012/0019343 | A1* | 1/2012 | Hsieh | H01F 17/0013 336/192 |
| 2013/0222101 | A1* | 8/2013 | Ito | H01F 17/04 336/83 |
| 2018/0142370 | A1* | 5/2018 | Riemer | C25D 7/00 |

FOREIGN PATENT DOCUMENTS

| | | |
|---|---|---|
| JP | 2006339460 | 12/2006 |
| JP | 2007158091 | 6/2007 |
| TW | 379894 | 1/2000 |
| TW | 481853 | 4/2002 |
| TW | 200402781 | 2/2004 |
| TW | I267134 | 11/2006 |
| TW | 200802633 | 1/2008 |
| TW | 201212068 | 3/2012 |
| TW | 201330707 | 7/2013 |

* cited by examiner

METHOD OF MANUFACTURING MULTI-LAYER COIL AND MULTI-LAYER COIL DEVICE

BACKGROUND OF THE INVENTION

1. Field of the Invention

The invention relates to a method of manufacturing a multi-layer coil and a multi-layer coil device and, more particularly, to a method of manufacturing a multi-layer coil by a plating process with varied current densities and a multi-layer coil device utilizing the multi-layer coil.

2. Description of the Prior Art

A choke, which is one kind of multi-layer coil device, is used for stabilizing a circuit current to achieve a noise filtering effect, and a function thereof is similar to that of a capacitor, by which stabilization of the current is adjusted by storing and releasing electrical energy of the circuit. Compared to the capacitor that stores the electrical energy by an electrical field (electric charge), the choke stores the same by a magnetic field.

In the past, the chokes are generally applied in electronic devices such as DC/DC converters and battery chargers, and applied in transmission devices such as modems, asymmetric digital subscriber lines (ADSL) or local area networks (LAN), etc. The chokes have also been widely applied to information technology products such as notebooks, mobile phones, LCD displays, and digital cameras, etc. Therefore, a height and size of the choke will be one of the concerns due to the trend of minimizing the size and weight of the information technology products.

As shown in FIG. 1, the choke 1 disclosed in U.S. Pat. No. 7,209,022 includes a core 10, a wire 12, an exterior resin 14, and a pair of electrodes 16, wherein the wire 12 is wound around the pillar 100 of the core 10. In general, the larger an area of the cross section of the pillar 100 is, the better the characteristics of the choke 1 are. However, since the winding space S has to be reserved for winding the wire 12, the area of the cross section of the pillar 100 is limited accordingly, so that saturation current cannot be raised effectively and direct current resistance cannot be reduced effectively. Furthermore, compared with the conventional winding-type coil structure, the wire has to be wound around the pillar by mechanical operation such that the size and thickness of the choke are limited accordingly (e.g. the size of the wire is reduced, the yield rate is reduced due to incorrect operation, and so on).

SUMMARY OF THE INVENTION

An objective of the invention is to provide a method of manufacturing a multi-layer coil by a plating process with varied current densities and a multi-layer coil device utilizing the multi-layer coil.

According to an embodiment of the invention, a method of manufacturing a multi-layer coil comprises steps of providing a substrate; forming a seed layer on the substrate; and plating the seed layer with N coil layers by N current densities according to N threshold ranges, so as to form the multi-layer coil on the substrate, wherein an i-th current density of the N current densities is lower than an (i+1)-th current density of the N current densities, N is a positive integer larger than 1, and i is a positive integer smaller than or equal to N. A first coil layer of the N coil layers is plated on the seed layer by a first current density of the N current densities. When an aspect ratio of an i-th coil layer of the N coil layers is within an i-th threshold range of the N threshold ranges, an (i+1)-th coil layer of the N coil layers is plated on the i-th coil layer by the (i+1)-th current density.

According to another embodiment of the invention, a multi-layer coil device comprises a substrate and a multi-layer coil. The multi-layer coil is formed on the substrate by N coil layers stacked with each other, and an aspect ratio of an i-th coil layer of the N coil layers is smaller than an aspect ratio of an (i+1)-th coil layer of the N coil layers, wherein N is a positive integer larger than 1, and i is a positive integer smaller than or equal to N.

As mentioned in the above, the invention forms the multi-layer coil on the substrate by a plating process with varied current densities, so as to replace the conventional winding-type coil with the plated multi-layer coil. The plated multi-layer coil occupies less space than the conventional winding-type coil such that the multi-layer coil device can be miniaturized easily and the characteristics of the multi-layer coil device can be enhanced effectively (e.g. increasing the area of the cross section of the pillar, reducing the direct current resistance, increasing the saturation current, and so on).

These and other objectives of the present invention will no doubt become obvious to those of ordinary skill in the art after reading the following detailed description of the preferred embodiment that is illustrated in the various figures and drawings.

DETAILED DESCRIPTION

Figure 1:
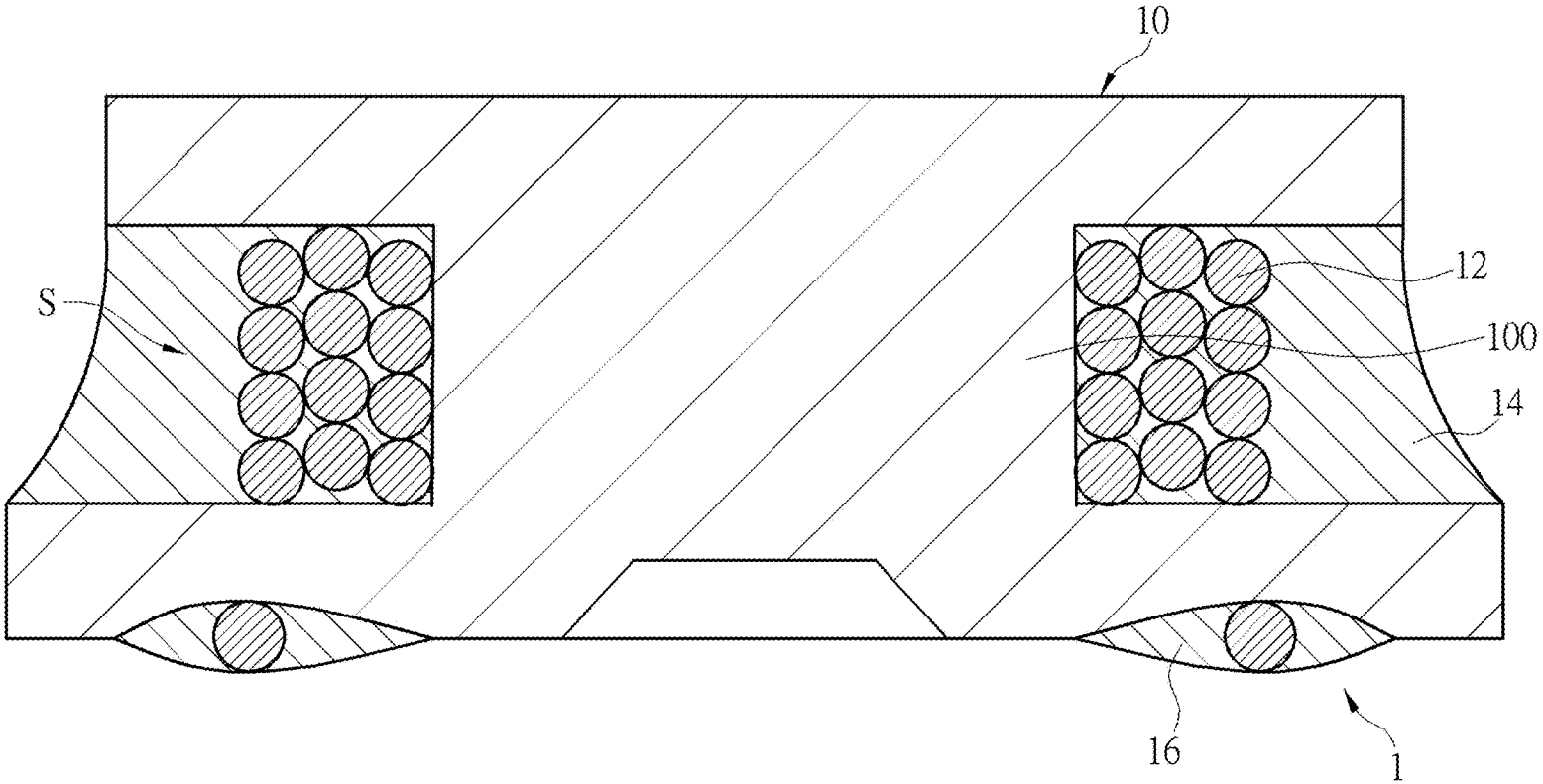
FIG. 1 PRIOR ART
FIG. 1 is a cross-sectional view illustrating a conventional choke.
Figure 2:
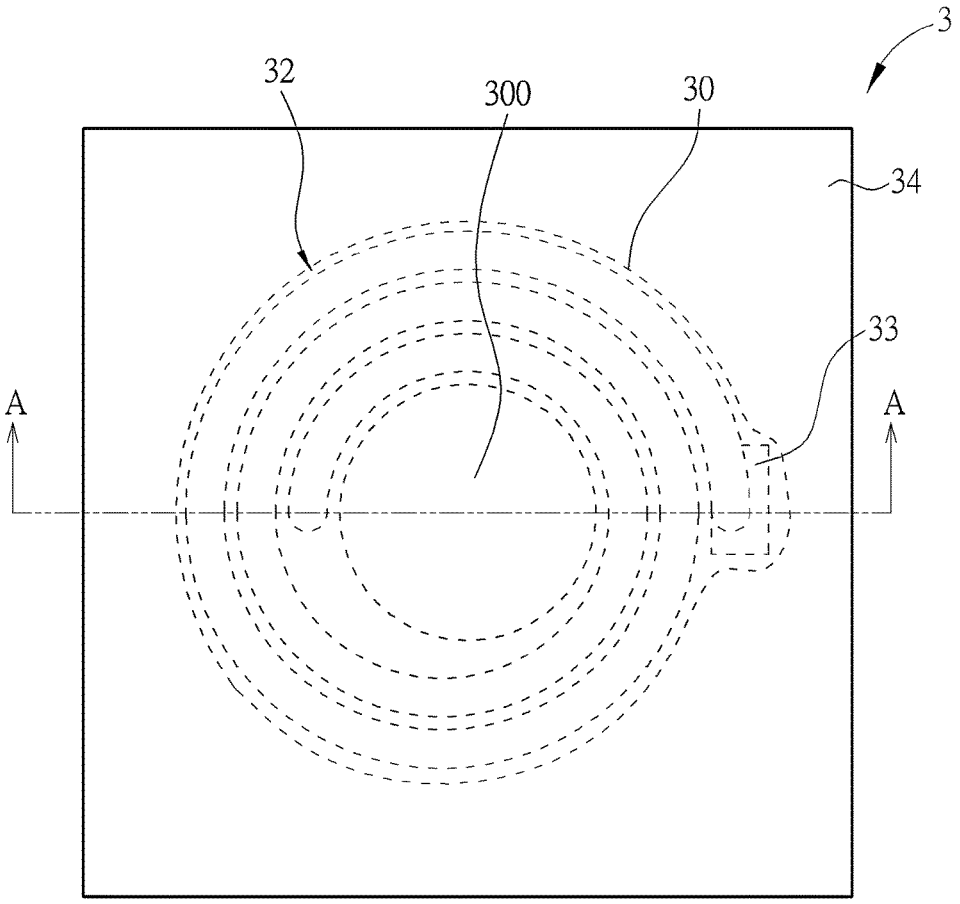
FIG. 2 is a top view illustrating a multi-layer coil device according to an embodiment of the invention.
Figure 3:
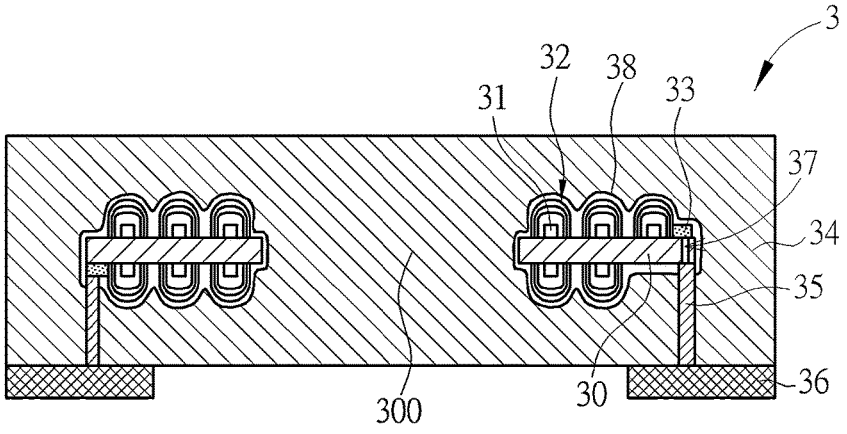
FIG. 3 is a cross-sectional view illustrating the multi-layer coil device along line A-A shown in FIG. 2.
Figure 4:
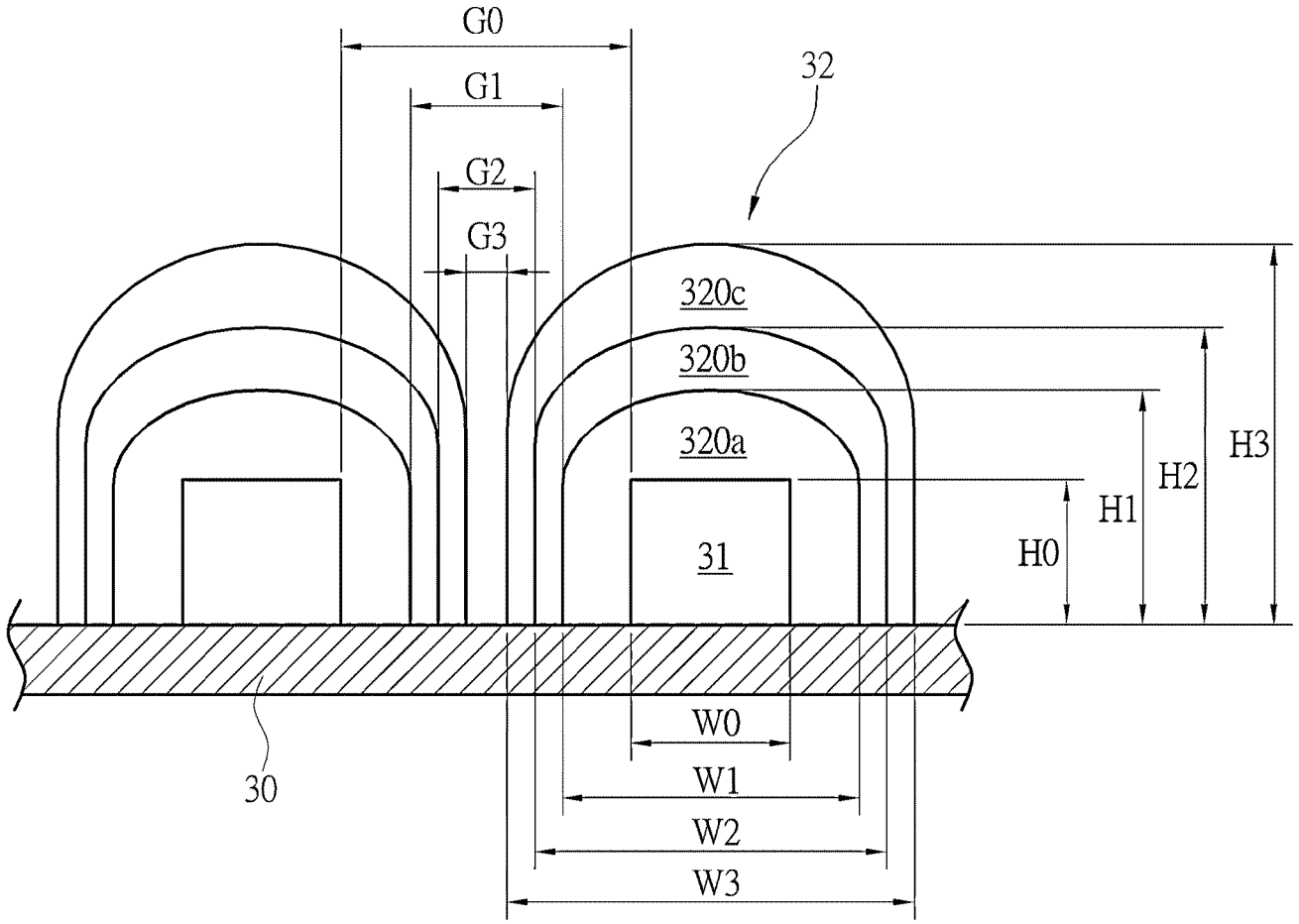
FIG. 4 is an enlarged view illustrating parts of the multi-layer coil shown in FIG. 3.
Figure 5:
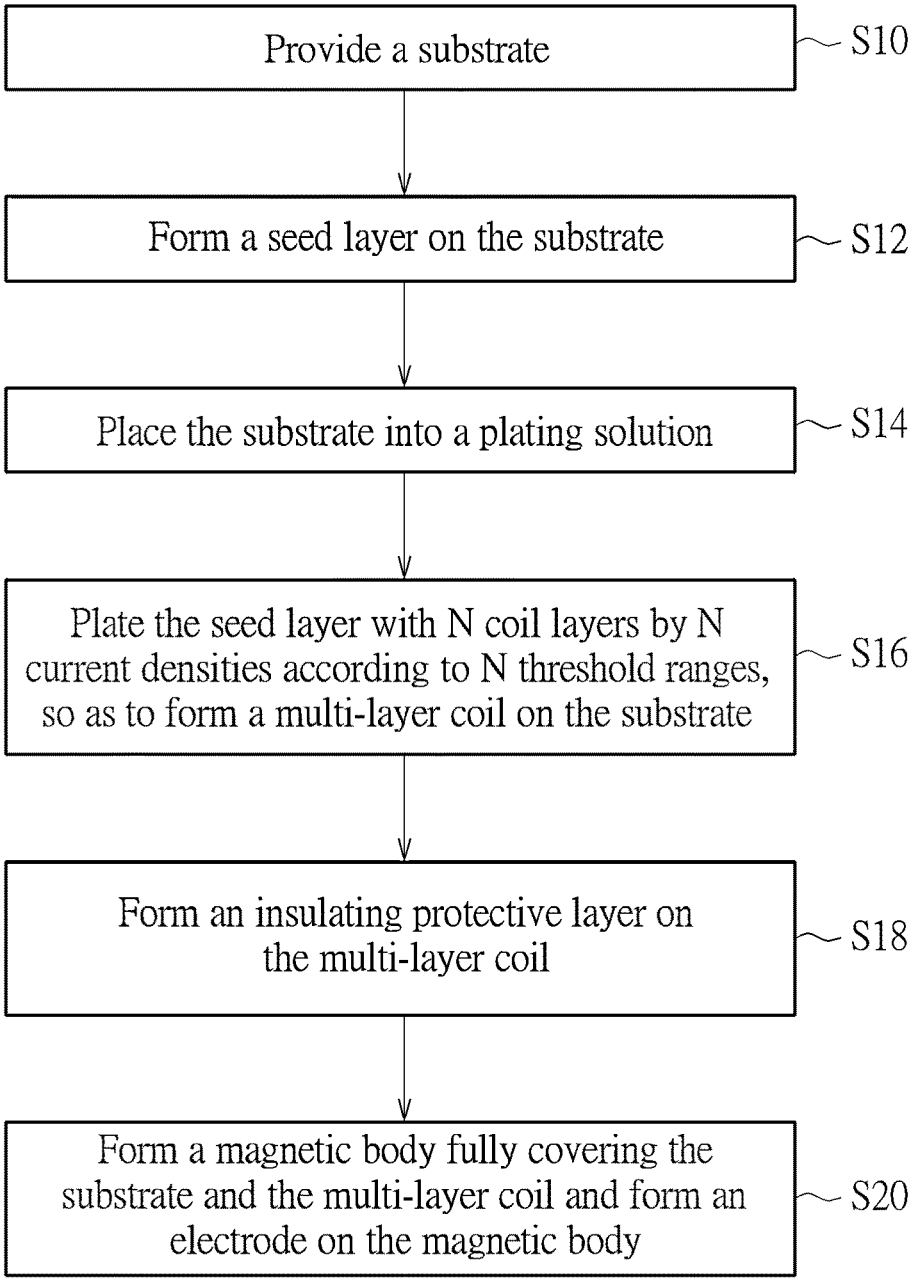
FIG. 5 is a flowchart illustrating a method of manufacturing the multi-layer coil device shown in FIG. 2 and the multi-layer coil shown in FIG. 3.

Referring to FIGS. 2 to 5, FIG. 2 is a top view illustrating a multi-layer coil device 3 according to an embodiment of the invention, FIG. 3 is a cross-sectional view illustrating the multi-layer coil device 3 along line A-A shown in FIG. 2, FIG. 4 is an enlarged view illustrating parts of the multi-layer coil 32 shown in FIG. 3, and FIG. 5 is a flowchart illustrating a method of manufacturing the multi-layer coil device 3 shown in FIG. 2 and the multi-layer coil 32 shown in FIG. 3. The multi-layer coil device 3 of the invention may be a current power module or component, a radio frequency component, a chip inductor, a choke, a transformer, or other magnetic components. According to this embodiment, the multi-layer coil device 3, such as a magnetic component, comprises a substrate 30, a multi-layer coil 32, a magnetic body 34 and a pair of electrodes 36. The multi-layer coil 32 is formed on the substrate 30 by a plating process with varied current densities. The magnetic body 34 fully covers the substrate 30 and the multi-layer coil 32. The electrodes 36 are formed on the magnetic body 34.

It should be noted that the multi-layer coil device 3 may be also formed without the magnetic body 34, such that, in addition to choke, the multi-layer coil 32 may be also formed on a silicon wafer, a glass substrate, a plastic substrate, a lead frame or a printed circuit board (PCB).

To manufacture the multi-layer coil 32, first of all, step S10 shown in FIG. 5 is performed to provide a substrate 30. In practical applications, the material of the substrate 30 may comprise, but not limited to, aluminum oxide ($Al_2O_3$) or a polymer, such as epoxy resin, modified epoxy resin, polyester, acrylic ester, fluoro-polymer, polyphenylene oxide, polyimide, phenolicresin, polysulfone, silicone polymer, bismaleimide triazine modified epoxy (BT Resin), cyanate ester, polyethylene, polycarbonate (PC), acrylonitrile-butadiene-styrene copolymer (ABS copolymer), polyethylene terephthalate (PET), polybutylene terephthalate (PBT), liquid crystal polymers (LCP), polyamide (PA), nylon, polyoxymethylene (POM), polyphenylene sulfide (PPS), orcyclicolefin copolymer (COC).

Afterward, step S12 shown in FIG. 5 is performed to form a seed layer 31 on the substrate 30. In practical applications, the seed layer 31 may be formed by, but not limited to, a plating process or an etching process with a copper foil. In this embodiment, the seed layer 31 is spiral-shaped and forms a plurality of rings. Then, step S14 shown in FIG. 5 is performed to place the substrate 30 into a plating solution. In this embodiment, the plating solution may essentially consist of, but not limited to, $CuSO_4$, $H_2SO_4$, $Cl^-$ and other additives (e.g. brightener, leveling agent, carriers, and so on). In other words, the composition of the plating solution may be changed and determined according to practical applications. Then, step S16 shown in FIG. 5 is performed to plate the seed layer 31 with N coil layers 320*a*, 320*b*, 320*c* by N current densities according to N threshold ranges, so as to form the multi-layer coil 32 on the substrate 30, wherein an i-th current density of the N current densities is lower than an (i+1)-th current density of the N current densities, N is a positive integer larger than 1, and i is a positive integer smaller than or equal to N. In this embodiment, Nis equal to, but not limited to, 3.

As shown in FIG. 4, the first coil layer 320*a* of the three coil layers 320*a*, 320*b*, 320*c* is plated on the seed layer 31 by the first current density of the three current densities. When an aspect ratio $$\frac{\Delta Y1}{\Delta X1}$$

of the first coil layer 320*a* is within the first threshold range, the second coil layer 320*b* is plated on the first coil layer 320*a* by the second current density, wherein ΔY1=H1−H0, ΔX1=(W1−W0)/2, H0 represents the height of the seed layer 31, W0 represents the width of the seed layer 31, H1 represents the total height of the first coil layer 320*a* and the seed layer 31, and W1 represents the total width of the first coil layer 320*a* and the seed layer 31. When an aspect ratio $$\frac{\Delta Y2}{\Delta X2}$$

of the second coil layer 320*b* is within the second threshold range, the third coil layer 320*c* is plated on the second coil layer 320*b* by the third current density, wherein ΔY2=H2−H1, ΔX2=(W2−W1)/2, H2 represents the total height of the second coil layer 320*b*, the first coil layer 320*a* and the seed layer 31, and W2 represents the total width of the second coil layer 320*b*, the first coil layer 320*a* and the seed layer 31.

In this embodiment, the first current density may be set as 5.39 ASD, the second current density may be set as 8.98 ASD, the third current density may be set as 10.78 ASD, the first threshold range may be set as 1~1.8, the second threshold range may be set as 2~2.8, and the third threshold range may be set as 2.8~4. Furthermore, the height H0 of the seed layer 31 may be 30 μm, the width W0 of the seed layer 31 may be 35 μm, and a gap G0 between two adjacent rings of the seed layer 31 may be 55 μm. First of all, the invention may plate the seed layer 31 with the first coil layer 320*a* by the first current density 5.39 ASD and measures the aspect ratio $$\frac{\Delta Y1}{\Delta X1}$$

of the first coil layer 320*a* during the plating process. When the measured aspect ratio $$\frac{\Delta Y1}{\Delta X1}$$

of the first coil layer 320*a* is within the first threshold range 1~1.8 (e.g. if ΔY1=17.1 μm and ΔX1=15 μm, $$\frac{\Delta Y1}{\Delta X1} = 1.14\Big),$$

the first current density 5.39 ASD can be switched to the second current density 8.98 ASD, so as to plate the first coil layer 320*a* with the second coil layer 320*b*. The aspect ratio $$\frac{\Delta Y2}{\Delta X2}$$

of the second coil layer 320*b* is still measured during the plating process. At this time, a gap G1 between every two first coil layers 320*a* can be calculated by the following equation, G1=G0−2ΔX1=55−2*15=25 μm. When the measured aspect ratio $$\frac{\Delta Y2}{\Delta X2}$$

of the second coil layer 320*b* is within the second threshold range 2~2.8 (e.g. if ΔY2=13.2 μm and ΔX2=5.5 μm, $$\frac{\Delta Y2}{\Delta X2} = 2.4\Big),$$

the second current density 8.98 ASD can be switched to the third current density 10.78 ASD, so as to plate the second coil layer 320*b* with the third coil layer 320*c*. The aspect ratio $$\frac{\Delta Y3}{\Delta X3}$$

of the third coil layer 320*c* is still measured during the plating process, wherein ΔY3=H3−H2, ΔX3=(W3−W2)/2, H3 represents the total height of the third coil layer 320*c*, the second coil layer 320*b*, the first coil layer 320*a* and the seed layer 31, and W3 represents the total width of the third coil layer 320*c*, the second coil layer 320*b*, the first coil layer 320*a* and the seed layer 31. At this time, a gap G2 between every two second coil layers 320*b* can be calculated by the following equation, G2=G1−2ΔX2=25−2*5.5=14 μm. When the measured aspect ratio $$\frac{\Delta Y3}{\Delta X3}$$

of the third coil layer 320*c* is within the third threshold range 2.8~4 (e.g. if ΔY3=13.5 μm and ΔX3=4.5 μm, $$\frac{\Delta Y3}{\Delta X3} = 3\Big),$$

a gap G3 between every two third coil layers 320*c* can be calculated by the following equation, G3=G2−2ΔX3=14−2*4.5=5 μm. When the measured aspect ratio $$\frac{\Delta Y3}{\Delta X3}$$

of the third coil layer 320*c* is within the third threshold range 2.8~4, the third current density 10.78 ASD can be switched to a fourth current density, so as to plate the third coil layer 320*c* with a fourth coil layer. However, since the size of the multi-layer coil 32 will change during the plating process, the mass transfer condition will change accordingly such that the plating effect will be influenced. Once the gap between two adjacent rings of the multi-layer coil 32 gets too small, the growth rate of the multi-layer coil 32 in lateral direction will decrease accordingly. Therefore, the invention can control the growth direction of the multi-layer coil 32 according to the aforesaid phenomenon. In this embodiment, the invention may use the third current density 10.78 ASD to form the third coil layer 320*c* in the plating process until the needed height of the multi-layer coil 32 is obtained.

It should be noted that the invention may also use more than three current densities from small to large to plate the seed layer with more than three coil layers according to practical applications.

In this embodiment, since the seed layer 31 is spiral-shaped and forms a plurality of rings, the multi-layer coil 32 is also spiral-shaped and forms a plurality of rings, and a gap between two adjacent rings is smaller than 30 μm. Preferably, the gap between two adjacent rings is smaller than 10 μm. As mentioned in the aforesaid embodiment, the gap G3 between two adjacent rings of the multi-layer coil 32 after the plating process may be 5 μm. Furthermore, the aspect ratio of the multi-layer coil 32 may be larger than 1.5 and the height of the multi-layer coil 32 may be larger than 70 μm, so as to enhance the characteristics of the multi-layer coil device effectively (e.g. reducing the direct current resistance, increasing the saturation current, and so on).

It should be noted that while forming the multi-layer coil 32 by the plating process, an electric layer 33 and an electric pole 35 may also be formed at opposite sides of the multi-layer coil 32 by the plating process simultaneously. Furthermore, the electric layer 33 located at the right side of FIG. 3 may be electrically connected to the electric pole 35 through a via hole 37.

Then, step S18 shown in FIG. 5 is performed to form an insulating protective layer 38 on the multi-layer coil 32 and between the two adjacent rings of the multi-layer coil 32. The insulating protective layer 38 may be made of epoxy resin, acrylic resin, polyimide (PI), solder resist ink, dielectric material, and so on.

Finally, step S20 shown in FIG. 5 is performed to form a magnetic body 34 fully covering the substrate 30 and the multi-layer coil 32 and to form an electrode 36 on the magnetic body 34. The electrode 36 is electrically connected to the multi-layer coil 32 through the electric pole 35 and the electric layer 33. Accordingly, the multi-layer coil 32 of the multi-layer coil device 3 essentially consists of three coil layers 320*a*, 320*b*, 320*c* stacked with each other, wherein the aspect ratio $$\frac{\Delta Y1}{\Delta X1}\text{(e.g. 1.14)}$$

of the first coil layer 320*a* is smaller than the aspect ratio $$\frac{\Delta Y2}{\Delta X2}\text{(e.g. 2.4)}$$

of the second coil layer 320*b*, and the aspect ratio $$\frac{\Delta Y2}{\Delta X2}\text{(e.g. 2.4)}$$

of the second coil layer 320*b* is smaller than the aspect ratio $$\frac{\Delta Y3}{\Delta X3}\text{(e.g. 3)}$$

of the third coil layer 320*c*.

In this embodiment, the magnetic body 34 comprises a pillar 300 penetrating the substrate 30. For example, the magnetic body 34 can be formed by pressure molding and firing an adhesive mixed with magnetic powder. Moreover, the magnetic powder may include iron powder, ferrite powder, metallic powder, amorous alloy or any suitable magnetic material, wherein the ferrite powder may include Ni—Zn ferrite powder or Mn—Zn ferrite powder, and the metallic powder may include Fe—Si—Al alloy (Sendust), Fe—Ni—Mo alloy (MPP), or Fe—Ni alloy (high flux).

It should be noted that after forming the multi-layer coil 32 by the plating process, a boundary line between every two adjacent coil layers may not be recognized by naked eyes. The multi-layer coil 32 could be etched by a wet etching process (such as using an ammonium persulfate etching agent) or processed by heat treatment to change grain boundary structure, such that the boundary line between every two adjacent coil layers can be recognized through an electron microscope.

Figure 6:
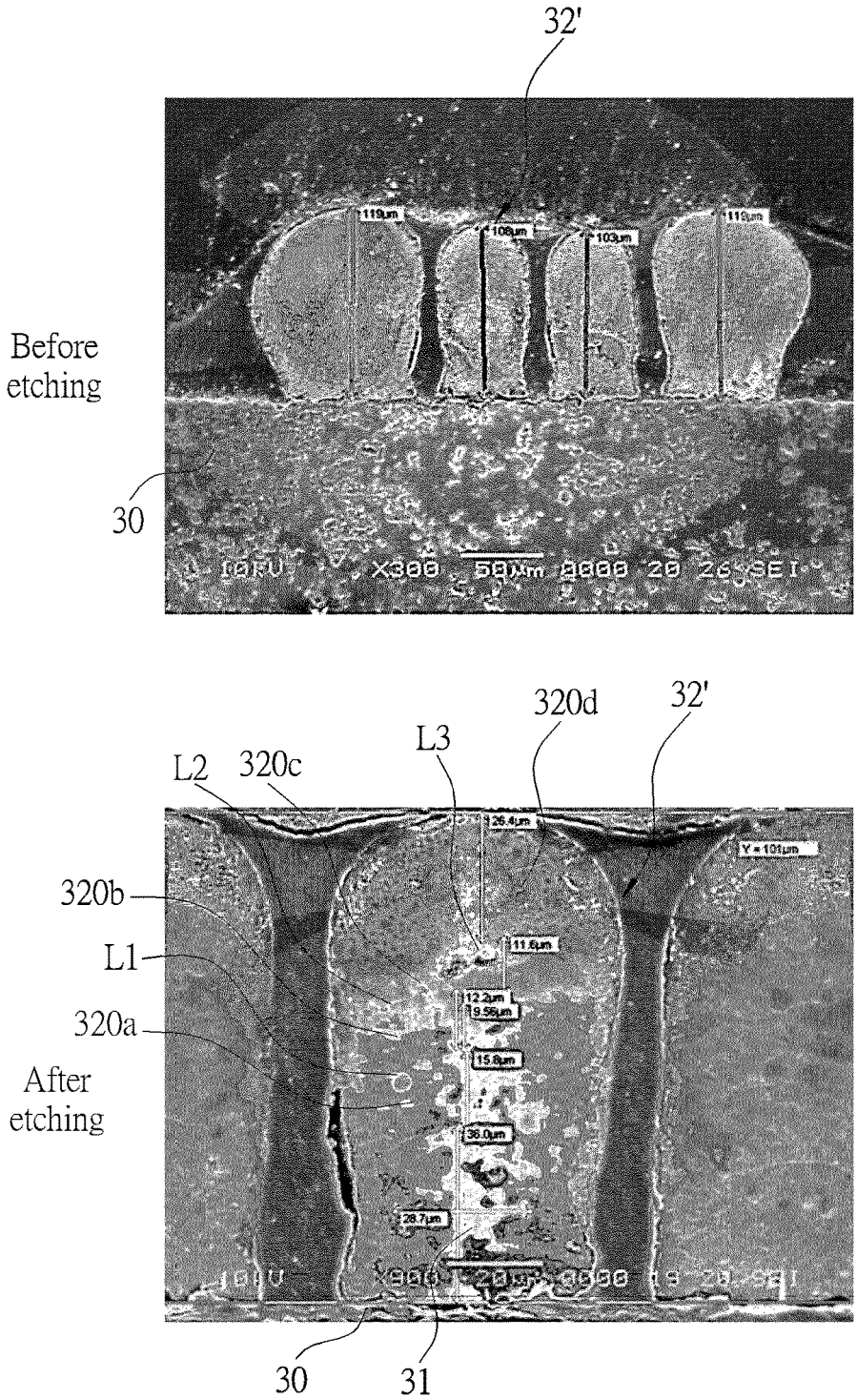
FIG. 6 is a microscopic view illustrating the structure of a multi-layer coil before and after etching.

Referring to FIG. 6, FIG. 6 is a microscopic view illustrating the structure of a multi-layer coil 32' before and after etching. As shown in FIG. 6, the multi-layer coil 32' has three boundary lines L1-L3 after etching, wherein the boundary line L1 is between the first coil layer 320*a* and the second coil layer 320*b*, the boundary line L2 is between the second coil layer 320*b* and the third coil layer 320*c*, and the boundary line L3 is between the third coil layer 320*c* and the fourth coil layer 320*d*. In other words, according to the three boundary lines L1-L3, the invention uses four current densities from small to large to plate the seed layer 31 with four coil layers 320*a*-320*d*, so as to form the multi-layer coil 32'.

As mentioned in the above, the invention forms the multi-layer coil on the substrate by a plating process with varied current densities, so as to replace the conventional winding-type coil with the plated multi-layer coil. The plated multi-layer coil occupies less space than the conventional winding-type coil such that the multi-layer coil device can be miniaturized easily and the characteristics of the multi-layer coil device can be enhanced effectively (e.g. increasing the area of the cross section of the pillar, reducing the direct current resistance, increasing the saturation current, and so on).

It should be noted that the feature of the invention is to form the multi-layer coil with high aspect ratio by the plating processing. That is to say, the invention can form a high or thick coil on a substrate or carrier, wherein the shape of the coil is not limited to circular. In addition to choke, the multi-layer coil may be also formed on a silicon wafer, a glass substrate, a plastic substrate, a lead frame or a printed circuit board (PCB).

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of manufacturing a multi-layer coil comprising:

providing a substrate;

forming a seed layer on the substrate, wherein the seed layer comprises a plurality of winding turns of a conductive wire, wherein each two adjacent winding turns of the conductive wire are separated by a gap; and plating N metal layers on the seed layer to encapsulate the plurality of winding turns of the conductive wire to form a multi-layer coil with N different current densities respectively, N being a positive integer not less than 3, wherein each metal layer is in contact with a different area of the top surface of the substrate to encapsulate a corresponding winding turn of the conductive wire, wherein the current density used for plating each metal layer increases as the level of the metal layer increases, and the current density difference between each two adjacent metal layers decreases as the level of the metal layer increases.

2. The method of claim 1, wherein the current density used for plating each metal layer is at a pre-determined current density and an aspect ratio of each metal layer is within a pre-determined range.

3. The method of claim 2, wherein the current density used for plating the bottom metal layer is at 5.39 ASD (amperes per square decimeter), wherein an aspect ratio of the bottom metal layer is from 1 to 1.8.

4. The method of claim 3, wherein the current density used for plating a second metal layer disposed on the bottom layer is 8.98 ASD (amperes per square decimeter), wherein an aspect ratio of the second metal layer is from 2 to 2.8.

5. The method of claim 4, wherein the current density used for plating a third metal layer disposed on the second metal layer is 10.78 ASD (amperes per square decimeter), wherein an aspect ratio of the third metal layer is from 2.8 to 4.

6. The method of claim 1, wherein the multi-layer coil is spiral-shaped with a plurality of rings, wherein a gap between two adjacent rings is smaller than 30 μm.

7. The method of claim 6, wherein the gap between two adjacent rings is smaller than 10 μm.

8. The method of claim 1, wherein an aspect ratio of the multi-layer coil is larger than 1.5 and a height of the multi-layer coil is larger than 70 μm.

9. The method of claim 1, further comprising forming an insulating protective layer on the multi-layer coil.

10. The method of claim 1, further comprising forming a magnetic body to enclose the substrate and the multi-layer coil.

11. The method of claim 10, wherein the magnetic body comprises a pillar penetrating the substrate.

12. The method of claim 10, further comprising forming an electrode on the magnetic body and an electric pole to electrically connect the multi-layer coil and the electrode.

13. The method of claim 1, wherein the material of the substrate comprises aluminium oxide ($Al_2O_3$).

14. The method of claim 1, wherein the substrate is a silicon wafer.

15. The method of claim 1, wherein the substrate is a glass substrate.

16. The method of claim 1, wherein the substrate is a lead frame.

17. The method of claim 1, wherein the substrate is a printed circuit board (PCB).

18. A method of manufacturing a multi-layer coil comprising:

providing a substrate;

forming a seed layer on the substrate, wherein the seed layer comprises a plurality of winding turns of a conductive wire, wherein each two adjacent winding turns of the conductive wire are separated by a gap; and plating at least three metal layers comprising a first metal layer, a second metal layer and a third metal layer on the seed layer to encapsulate the plurality of winding turns of the conductive wire to form a multi-layer coil with different current densities respectively, wherein each metal layer is in contact with a different area of the top surface of the substrate to encapsulate a corresponding winding turn of the conductive wire, wherein the second metal layer is disposed on the first metal layer and the third metal layer is disposed on the second metal layer, wherein a first current density used for plating the first metal layer is less than a second current density used for plating the second metal layer, and the second current density used for plating the second metal layer is less than a third current density used for plating the third metal layer, wherein the difference between the second current density and the first current density is greater than the difference between the third current density and the second current density.

19. The method of claim 18, further comprising forming a magnetic body to enclose the substrate and the multi-layer coil.

* * * * *